US005174120A

United States Patent [19]

Silvestri, Jr.

[11] Patent Number: 5,174,120

[45] Date of Patent: Dec. 29, 1992

[54] TURBINE EXHAUST ARRANGEMENT FOR IMPROVED EFFICIENCY

[75] Inventor: George J. Silvestri, Jr., Winter Park, Fla.

[73] Assignee: Westinghouse Electric Corp., Pittsburgh, Pa.

[21] Appl. No.: 666,321

[22] Filed: Mar. 8, 1991

[51] Int. Cl.[5] ..... F01K 9/00; F01K 11/02

[52] U.S. Cl. ..... 60/692; 60/693; 60/694; 60/697

[58] Field of Search ..... 60/690, 692, 693, 694, 60/697

[56] References Cited

U.S. PATENT DOCUMENTS

| | | | |
|---|---|---|---|
| 1,372,930 | 3/1921 | Baumann et al. | 60/693 |
| 4,156,349 | 5/1979 | Silvestri, Jr. | 60/692 |
| 4,553,396 | 11/1985 | Heizer | 60/693 X |
| 4,557,113 | 12/1985 | Silvestri, Jr. et al. | 60/693 |
| 4,567,729 | 2/1986 | Roddis | 60/692 |
| 4,628,212 | 12/1986 | Uehara et al. | 60/693 |

OTHER PUBLICATIONS

Oleson et al.; "Dry Cooling for Large Nuclear Power Plants"; Power Generation Systems Report No. Gen-7-2-004; Feb., 1972; pp. 11-1 through 11-20.

Elliott et al.; "Air-Cooled Concensers"; *Power;* Jan., 1990; pp. 13-21.

Kosten et al.; "Operating Experience and Performance Testing of the World's Largest Air-Cooled Condenser"; Proceedings of the American Power Conference; 1981; vol. 43, pp. 400-412.

*Primary Examiner*—Allen M. Ostrager

[57] ABSTRACT

Steam exhaust outlets of a low pressure steam turbine are fitted with a divider plate to separate exhaust steam into isolated flow paths in fluid communication with a condenser. Separation of the flow paths is maintained through the condenser so that heat rate is improved by lower average back pressure and higher temperature condensate exiting the condenser. In a double flow turbine, a further divider plate separates steam from one exhaust outlet from that of the other exhaust outlet thereby creating four steam flow paths to the condenser.

6 Claims, 2 Drawing Sheets 41A
25
1
37
17
47A
21B
21A
47B
39
45
23A
35A
23B
19
45
35B
23
21
31
29
41B
33
27
9
7
11
5
3
15
13

TURBINE EXHAUST ARRANGEMENT FOR IMPROVED EFFICIENCY

This invention relates to steam turbine power generating system and, more particularly, to a multiple zoned low pressure turbine exhaust.

BACKGROUND OF THE INVENTION

Environmental protection and limited water availability have necessitated the adoption of larger temperature rises in the condensers of utility power plants. There has been increased use of cooling ponds and wet cooling towers (both natural and mechanical draft) and in some instances, dry cooling. An increase in turbine exhaust pressure has accompanied the adoption of these supplementary cooling systems. This not only reduces the plant efficiency but also places additional demands on the cooling system.

In the United States, dry cooling has been limited to one utility with an initial application on a 20 MW turbine and a subsequent 360 MW unit. Both of the applications were with air cooled condensers. South Africa has built six 665 MW units with air cooled condensers, with three more under construction. In other applications, indirect air cooling is used in which exhaust steam is channeled through a dry tower, usually a natural draft design. South Africa has built six 668 MW units using indirect air cooling. A number of smaller size indirect designs were built in England, Germany, Hungary, U.S.S.R., Iran, Brazil, Turkey, and South Africa. These plants employed either spray or surface condensers.

In at least one dry cooling study of a nuclear power plant, it was established that the use of multipressure or zoned condensers improved the plant economics. Moreover, the use of different size last row blades in each low pressure (LP) element (tandem compound six flow exhaust) further improved the economics. In this instance, the lowest pressure LP element had the largest exhaust annular area with decreasing annulus areas in the higher pressure LP elements. The economic benefit and improvement in turbine performance increases with the number of multipressure levels or zones. Under conventional practice the number of zones corresponded to the number of LP elements. However, U.S. Pat. No. 4,557,113 assigned to the assignee of the present invention, discloses a turbine system having separate zones in each half of a double flow LP element with downward exhaust. From the disclosed system, it is possible to obtain two zones with a single LP element, four zones with two double flow LP elements and six zones with three double flow LP elements.

U.S. patent application Ser. No. 07/317,495, filed Mar. 1, 1989, assigned to the assignee of the present invention, proposes to vary the gaugings on the last stage (rotating and stationary blades) by reorientating the blade foil while keeping the rotating blade profile the same to optimize the performance in the various zones of the LP turbines and to use different size last row blades in each half of a double flow LP element to achieve more optimum performance if the differences in exhaust pressure were large enough in the various zones. Turbines have been built in which the individual LP turbines of a specific unit have different length last row blades.

With dry finned tubes of air cooled condensers, the temperature of the cooling air rises substantially. The gradient for the transfer of heat is the difference in temperature of the air and the condensing steam. The tubes of the dry finned sections must be comparatively shallow, which means that usually not more than three to six rows of tubes are crossed in succession by the air passing over them. The successive increase in air temperature will produce a successively higher steam condenser pressure in each row, although this is sometimes ameliorated by varying the fin spacing of each row.

The different condensing pressures must equalize in the headers so that: (1) the condensate from all tubes will drain completely; and (2) the air in all tubes will be separated and evacuated. In one exemplary system, the air cooled condenser operates at approximately 15° C. lower saturation temperature owing to pressure loss in the steam duct (connecting the turbine exhaust flange and the air cooled condenser) and the condensing elements.

Because of the tendency of the air cooled condenser to produce successively higher steam condenser pressures in each row of tubes (as the air successively increases in temperature in passing through the air cooled condenser), it is especially suited to multi-pressure or zoning operation. In this case, the lowest pressure zone would occur in the first row of tubes and the highest pressure zone in the last row of tubes.

In May, 1979 the assignee of the present invention was granted a patent on a zoned or multipressure system for a "Dry Cooling Plant System" (U.S. Pat. No. 4,156,349). In this instance, the LP steam turbines exhausted to steam condensers-ammonia reboilers. The ammonia evaporated, was ducted to the air cooling tower where it condensed, and returned to the condenser-reboiler. In this instance, the ammonia from one condenser-reboiler went to the cooling tower tubes that received the inlet cooling air. The ammonia from the other condenser-reboiler went to the cooling tower tubes that received hot air leaving the first group of tubes. So, the steam turbine operated with two pressure zones on a dry cooled plant.

It was noted that increasing the number of condensing zones or pressure levels improves cycle performance and economics of indirect air cooled plants because of the large cooling range (large temperature rise) typical of dry cooled systems. In the case of air cooled condensers, there is an inherent tendency for each row of condenser tubes to operate at successively higher pressure as the air passes through the condenser system.

Moreover, many wet cooling systems with conventional steam condensers have large temperature rises and are especially suited to multi-pressure or zoned condenser applications. As noted earlier, increasing the number of pressure zones improves performance on both indirect air cooled and wet cooling tower plants. The problem is that the number of zones is limited to the number of turbine exhaust flows. The aforementioned U.S. Pat. No. 4,557,113 discloses a system in which two zones are obtainable on a double flow LP element, i.e., a condenser is divided into two zones with exhaust from one end of the turbine coupled to one of the zones and exhaust from the other end of the turbine coupled to the other of the zones. The advantages of this two zone system suggest that more zones might provide additional improvement. However, it has been believed that the number of zones is limited to the number of available turbine exhausts.

If it were possible to obtain more than two exhaust pressure zones on a double flow LP element or multiple pressure zones on a single flow LP element, additional improvements could be obtained. Table I illustrates the pressure levels and increase in available energy from use of a low pressure zone in a two zone single flow LP element over single pressure operation, both designs having a 20.0° C. temperature rise of the cooling water. $T_0$ is the incoming cooling water temperature. $T_2$ is the cooling water outlet from the second zone of a multi-pressure, two zone condenser. $P_2$ and $P_1$ are the saturation (condensing) pressures corresponding to $T_2$ and $T_1$, respectively. The portion of the exhaust steam (approximately half) that exhausts to the low pressure zone has between 15.5 and 16.4 Kcal/Kg more available energy than the steam in the single pressure design. The increase in available energy is dependent upon the initial condenser temperature which was varied between 30° C. and 56.7° C., corresponding to a range of water temperatures leaving a cooling tower.

In Table II, a single pressure and a four pressure zoned condenser are compared. In this case, $T_0$ is the initial cooling water temperature with $T_4$ being the water temperature leaving the last zone. $T_1$, $T_2$, and $T_3$ are the water temperatures leaving the other zones. $P_1$, $P_2$, $P_3$, and $P_4$ are the condensing pressures in the various zones. $P_4$ is also the condensing pressure of an unzoned or single pressure design. There are corresponding increases in available energy of the steam expanding in the various zones above the available energy of the single pressure design.

Tables III and IV relate to comparisons between one zone and two zone and one zone and four zone designs, respectively, for a temperature rise of 13.3° C. The temperature rises in dry cooling systems would probably approach the 20.0° C. level while the 13.3° C. to 20.0° C. range would be more typical of natural draft wet cooling towers. Fossil units with natural draft wet cooling towers would tend to be in the lower half of the 13.3° C. to 20.0° C. range while nuclear units would be in the upper half of this range. Fossil applications with wet type mechanical draft cooling towers generally have temperature rises between 8.3° C. and 13.9° C. while nuclear plants with mechanical draft towers would usually have temperature rises between 13.3° C. and 16.7° C. In areas with low humidity, mechanical draft wet towers have been built with temperature rises of 16.7° C. to 20.0° C.

Tables V and VI identify the steam temperatures and pressures in the various zones for single, two, and four zone combinations with 13.3° C. and 20.0° C. temperature rises and given conditions in the maximum pressure zone.

Calculations were made with the standard hood loss on the turbine configuration utilized to evaluate zoning as well as with 0.56, 1.11, and 1.67 Kcal/Kg hood loss increases. Table VII compares single or unzoned performance with two zone performance, and 13.3° C. temperature rises. The two zone performance is presented with 0, 0.56, 1.11, and 1.67 Kcal/Kg increases in hood loss. Table VIII presents comparable data but with a 20.0° C. temperature rise.

Both of these comparisons relate to a single flow LP section. Even with a 1.67 Kcal/Kg increase in hood loss, there is still an output increase with two zones. The increase in output is larger with a 20.0° C. rise than with a 13.3° C. rise.

If the turbine had a double flow LP element, it could be built with two zones as shown in the aforementioned U.S. Pat. No. 4,577,113. For that design, there would be no increase in hood loss for a given exhaust volumetric flow.

It is obvious that there is a significant increase in available energy with multi-pressure. For the case of two versus one zone, the increase is between 7.72 and 8.22 Kcal/Kg for a 20.0° C. rise and 5.33 to 5.61 Kcal/Kg for a 13.3° C. rise, based on the total exhaust flow (half of value shown on Tables I and III). In the case of four versus one zone, the increase is between 11.6 and 12.3 Kcal/Kg for a 20.0° C. rise and between 8.06 and 8.39 Kcal/Kg for a 13.3° C. rise, based on the total exhaust flow (half of value shown on Tables II and IV).

Tables V and VI identify the pressures associated with the various zoning configurations for various maximum condensing temperatures and condenser temperature rises of 13.3° C. and 20.0° C.

SUMMARY OF THE INVENTION

The above described advantages of a multi-zone turbine system are attained in one form of the present invention by placing a divider plate along the vertical axis (axial orientation) of a turbine exhaust to create two pressure zones in each end of a downflow or upflow exhaust. In the case of side exhausts in both cover and base halves of a turbine, the divider plate may be placed along either the horizontal or vertical center line but maintaining an axial orientation. With an axial exhaust, the divider plate may also be placed along either the vertical or horizontal center line depending upon the condenser orientation.

Because of the differences in exhaust pressure on each side of the divider plate, there would be incidence at the leading edge of the divider plate at the last rotating blade exit annular. The inlet edge of the plate would be placed far enough downstream so that the last row blades do not make contact because of differential movement during speed and load changes.

BRIEF DESCRIPTION OF THE DRAWINGS

For a better understanding of the present invention, reference may be made to the following detailed description taken in conjunction with the accompanying drawings in which.

DETAILED DESCRIPTION OF THE INVENTION

Figure 1:
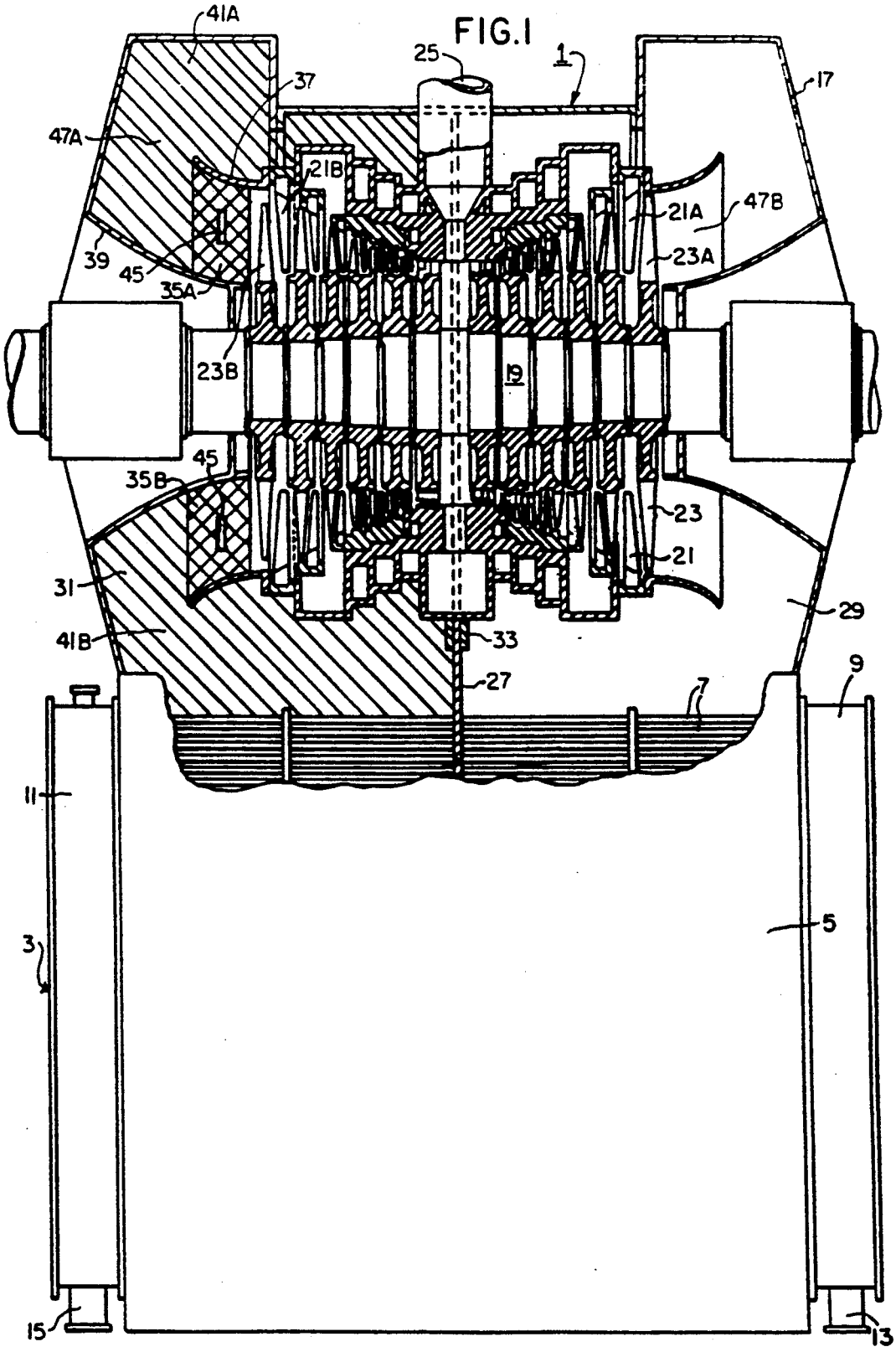
FIG. 1 is a simplified, partial cross-sectional view of a double flow steam turbine in which a flow-divider of the present invention is shown in the left-hand exhaust outlet.

Referring to FIG. 1, there is shown a low pressure double flow steam turbine element 1 and a zoned or multi-pressure condenser 3 incorporating the teaching of the present invention.

The condenser 3 comprises a shell portion 5 which encloses a plurality of horizontally disposed straight tubes 7 with water boxes or headers 9 and 11 disposed on opposite ends of the shell 5 and tubes 7. An inlet cooling water nozzle 13 is disposed in fluid communication with one of the headers 9 and an outlet cooling water nozzle 15 is disposed in fluid communication with the other header 11 so that influent cooling water enters the right-hand end of the tubes 7 and effluent cooling water is discharged from the left-hand end of the tube 7 as shown in FIG. 1.

The turbine comprises a casing or housing 17 which is disposed in fluid communication with the shell 5 of the condenser 3. Rotatably disposed within the housing 17 is a rotor 19 and a plurality of stationary and rotatable interdigitated blade rows 21 and 23, respectively, forming two steam flow paths which originate at the central portion of the housing 17 and extend axially in opposite directions to the axial ends of the turbine 1. A steam inlet nozzle 25 is disposed in the center portion of the housing 17 to supply steam to the blade rows in each flow path.

A partition plate or baffle 27, which may include more than one plate, is disposed within the shell 5 and housing 17 so as to form two separate chambers 29 and 31 within the shell 5 and housing 17. The chamber 29 has tubes with influent cooling water flowing therethrough and the chamber 31 has tubes with effluent cooling water flowing therein so that the back pressure in the chamber 31 which are, respectively, called low and high pressure chambers 29 and 31. The partition plate 27 may be attached to the condenser or turbine housing by welding on one side and provided with a tongue-and-groove arrangement as shown generally at 33 wherever necessary to allow for thermal expansion of the partition plate 27.

The last row of rotatable blades 23A on the right-hand end of the steam flow path which discharge into the low pressure chamber 29 may be longer than the last row of rotatable blades 23B on the left-hand side of the steam flow path which discharges into the high pressure chamber 31, and may include corresponding changes in the last row of stationary blades 21A and 21B. The gauging of the last row of stationary blades 21A or rotating blades 23A may be greater than the gauging in the last row of stationary blades 21B or rotating blades 23B in the flow path.

The zoned or multi-pressure condenser and turbine combination of FIG. 1 as thus far described will have up to 0.7% better thermal performance than units without multiple pressure or zoned condensers. As previously discussed, Applicants believe that further performance improvement can be attained if the turbine exhaust can be divided into additional zones.

The left-hand half of FIG. 1 illustrates one embodiment of the present invention. A pair of vertical divider plates 35A, 35B are attached to outer flow guide 37 and to inner flow guide 39, which define an exhaust outlet 47A, and extend therebetween to effectively divide the steam exiting the turbine into a left half and a right half portion 47A', 47A" when viewed from the exhaust end. Division of the steam into two separate portions is completed by another pair of vertical divider plates 41A, 41B attached to the outer cylinder wall or housing 17. The plates 41A, 41B are coupled to respective ones of the plates 35A, 35B by tongue and groove or other form of resilient joint, such as joint 33, which joint both facilitates assembly and accommodates any differential thermal expansion of the coupled plates. The plates 41A, 41B may also be welded or otherwise joined to abutting surfaces of the outer flow guide 37, inner cylinder housing 43, and plate 27. As with plate 33, the plate 41B extends through the condenser 3 further dividing the left-hand half of condenser 3 into a front and rear section 3A, 3B as viewed in FIG. 1.

While only one exhaust end of the double flow turbine of FIG. 1 has been shown as incorporating a flow-divider in accordance with the present invention, it will be appreciated that a similar flow-divider could be used on the other exhaust end, with the condenser 3 being further divided into two zones on its right half side. Assuming that the left-hand half of the turbine of FIG. 1 represents a single flow exhaust turbine, a substantial increase in output, i.e., a decrease in heat rate, can be realized. Furthermore, while a vertically oriented divider plate is shown for the axially aligned exhaust annuli 47A, 47B of FIG. 1, a horizontal divider plate along the horizontal axis or a vertical plate perpendicular to the axis may be used in side exhaust turbines. Other arrangements of divider plates adapted for a particular exhaust will be apparent.

Figure 2:
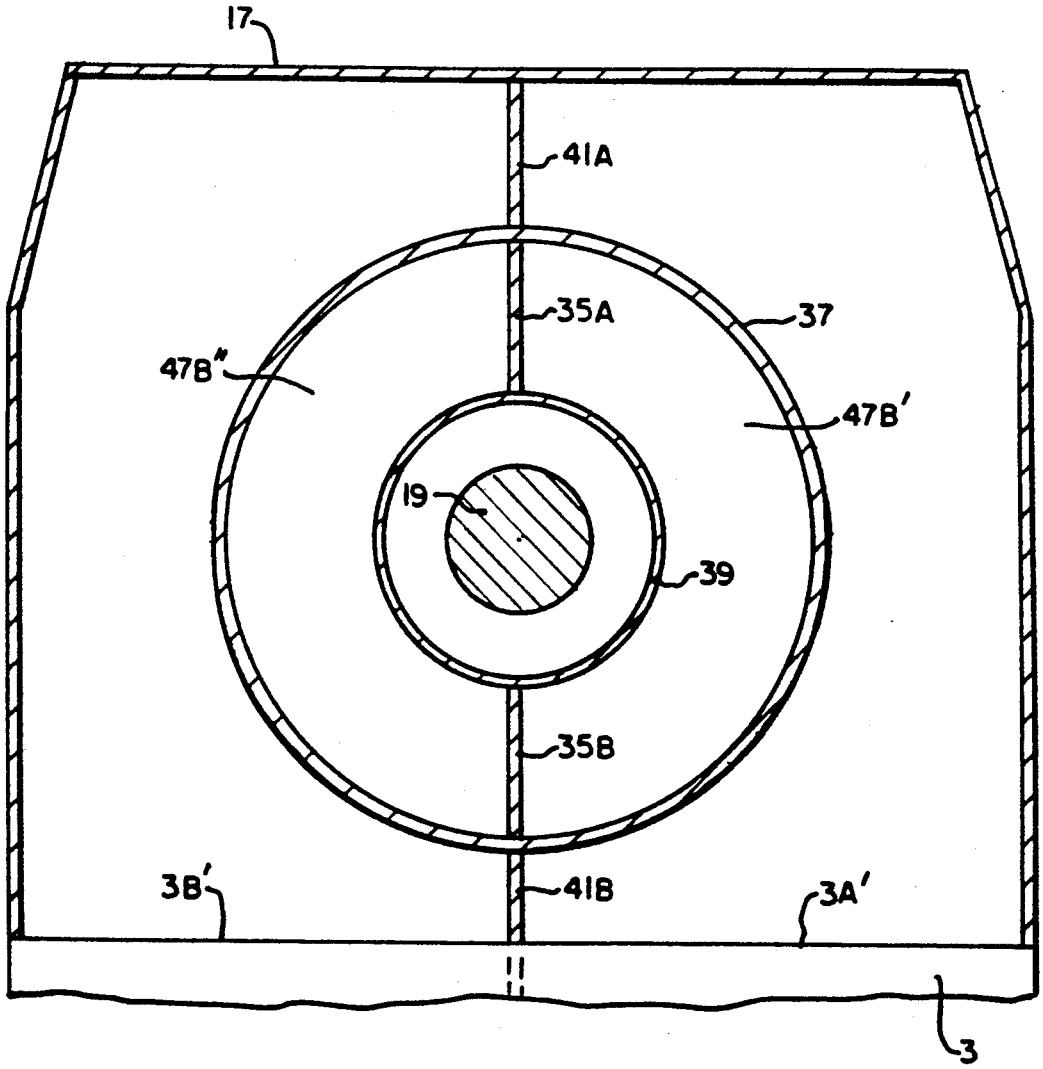
FIG. 2 is a simplified, partial cross-sectional view taken through the right-hand end of FIG. 1 to illustrate how it would appear with a flow-divider plate of the present invention.

Referring to FIG. 2, there is shown an end view of the turbine of FIG. 1 which, for purposes of description, will be assumed to be the right-hand end and will be further assumed to incorporate flow-divider plates 41, 35 in accordance with the above description of the left-hand end of FIG. 1. Since each end is essentially a mirror image of the other, the same reference numbers are used on both ends except that the exhaust annulus is designated 47B on the right-hand end. The two plates 41 and 35, further divided into A and B segments, separated the exhaust flow into two fluid paths, one designated 47B' and the other 47B". Each fluid path is coupled to separate sections 3A', 3B' of the condenser 3.

While the improvement is considerably lower on a double flow exhaust such as that of FIG. 1 in which the teachings of U.S. Pat. No. 4,557,113 have been incorporated, the improvement can reasonably be expected to be between 0.25% and 0.7% depending upon the condenser rise. If the heat rate improvement comparison is made with an unzoned double flow exhaust, the improvement would be in excess of 1%. If the turbine has side exhausts, the increase in hood loss is minimal with the proposed arrangement.

Angled slots 45 may be formed in the divider plates 35A, 35B to transfer flow between a high pressure zone and a lower pressure zone resulting from the swirl that occurs at higher exhaust pressures and thereby reduce flow separation in the hood.

The incorporation of the divider plates 35, 41 at the turbine blading exhaust results in substantial reduction in heat rate. The maximum improvement occurs when it is applied on a single flow exhaust with output increases of about 1%, in spite of increased hood loss. With side exhaust turbines, there is a potential increase of still greater magnitude. When comparing a four zone arrangement (left and right-hand ends of FIG. 1 being divided) with a two zone arrangement as shown in U.S. Pat. No. 4,557,113, an improvement of 0.25% and 0.5% is feasible. Although the blading experiences shock loading as it moves from one zone to another, the clearance between the blade exit plane and the divider inlet allows this transition to be reduced in severity.

While there is an anticipated exhaust pressure differential across the divider plates 35, incidence occurs along the leading edge of the plates. This incidence would result in poorer hood performance than would occur with single pressure operation without the divider. Table VII (13.3° C. rise) and Table VIII (20.0° C. rise) compare a single or unzoned design with a two zone design with 0, 0.56, 1.11, and 1.67 Kcal/Kg increases in hood loss. Table IX (13.3° C. rise) and Table X (20.0° C. rise) compared the two zone design (with no increase in hood loss) with the four zone design with 0, 0.56, 1.11, and 1.67 Kcal/Kg increases in hood loss. The reason for the negative improvement at low exhaust steam temperature is two-fold. First, the low pressure zones are choked and cannot utilize all of the improvement in exhaust pressure. See 42.2° C. case on Table IX. Second, the performance in the highest pressure zone is degraded because of the increased hood loss.

In reality, the hood loss increase should be close to zero at the low steam temperatures because the turbine exhaust flow is close to axial and there would be low incidence on the divider between the two halves at a given flow. At the high exhaust temperatures, the increase in hood loss would be closer to the 1.67 Kcal/Kg value.

While the principles of the invention have now been made clear in an illustrative embodiment, it will become apparent to those skilled in the art that many modifications of the structures, arrangements, and components presented in the above illustrations may be made in the practice of the invention in order to develop alternate embodiments suitable to specific operating requirements without departing from the spirit and scope of the invention as set forth in the claims which follow.

TABLE I

TWO ZONE VS SINGLE ZONE (UNZONED) PERFORMANCE 20.0° C. Temperature Rise

| Sat. Temp. °C. | Sat. Press Kcal/sqcm | Moisture, %, at P2 | Isentropic Enthalpy Kcal/Kg | Increased Heat Drop Kcal/Kg |
|---|---|---|---|---|
| T2 = 76.7 | P2 = .4213 | 3.00 | h2 = 613.5 | 0.0 |
| T1 = 66.7 | P1 = .2747 | | h1 = 598.0 | 15.5 |
| T0 = 56.7 | | | | |
| T2 = 72.2 | P2 = .3496 | 3.70 | h2 = 607.8 | 0.0 |
| T1 = 62.2 | P1 = .2250 | | h1 = 592.1 | 15.7 |
| T0 = 52.2 | | | | |
| T2 = 66.7 | P2 = .2747 | 4.51 | h2 = 600.8 | 0.0 |
| T1 = 56.7 | P1 = .1738 | | h1 = 585.1 | 15.7 |
| T0 = 46.7 | | | | |
| T2 = 61.1 | P2 = .2138 | 5.50 | h2 = 592.8 | 0.0 |
| T1 = 51.1 | P1 = .1329 | | h1 = 576.7 | 16.1 |
| T0 = 41.1 | | | | |
| T2 = 55.6 | P2 = .1648 | 6.44 | h2 = 585.0 | 0.0 |
| T1 = 45.6 | P1 = .1005 | | h1 = 568.7 | 16.3 |
| T0 = 35.6 | | | | |
| T2 = 50.0 | P2 = .1258 | 7.56 | h2 = 576.1 | 0.0 |
| T1 = 40.0 | P1 = .0752 | | h1 = 559.7 | 16.4 |
| T0 = 30.0 | | | | |

TABLE II

FOUR ZONE VS SINGLE (UNZONED) ZONE PERFORMANCE 20.0° C. Temperature Rise

| Sat. Temp. °C. | Sat. Press Kcal/sqcm | Moisture, %, at P2 | Isentropic Enthalpy Kcal/Kg | Increased Heat Drop Kcal/Kg |
|---|---|---|---|---|
| T4 = 76.7 | P4 = .4213 | 3.00 | h4 = 613.5 | 0.0 |
| T3 = 71.7 | P3 = .3414 | | h3 = 605.8 | 7.7 |
| T2 = 66.7 | P2 = .2747 | | h2 = 598.0 | 15.5 |
| T1 = 61.7 | P1 = .2193 | | h1 = 590.2 | 23.3 |
| T0 = 56.7 | | | | |
| T4 = 72.2 | P4 = .3496 | 3.70 | h4 = 607.8 | 0.0 |
| T3 = 67.2 | P3 = .2815 | | h3 = 599.9 | 7.9 |
| T2 = 62.2 | P2 = .2250 | | h2 = 592.1 | 15.7 |
| T1 = 57.2 | P1 = .1784 | | h1 = 584.2 | 23.6 |
| T0 = 52.2 | | | | |
| T4 = 66.7 | P4 = .2747 | 4.51 | h4 = 600.8 | 0.0 |
| T3 = 61.7 | P3 = .2193 | | h3 = 593.0 | 7.8 |
| T2 = 56.7 | P2 = .1738 | | h2 = 585.1 | 15.7 |
| T1 = 51.7 | P1 = .1366 | | h1 = 577.0 | 23.8 |
| T0 = 46.7 | | | | |
| T4 = 61.1 | P4 = .2138 | 5.50 | h4 = 592.8 | 0.0 |
| T3 = 56.1 | P3 = .1693 | | h3 = 584.8 | 8.0 |
| T2 = 51.1 | P2 = .1329 | | h2 = 576.7 | 16.1 |
| T1 = 46.1 | P1 = .1034 | | h1 = 568.6 | 24.2 |
| T0 = 41.1 | | | | |
| T4 = 55.6 | P4 = .1648 | 6.44 | h4 = 585.0 | 0.0 |

TABLE II-continued

FOUR ZONE VS SINGLE (UNZONED) ZONE PERFORMANCE 20.0° C. Temperature Rise

| Sat. Temp. °C. | Sat. Press Kcal/sqcm | Moisture, %, at P2 | Isentropic Enthalpy Kcal/Kg | Increased Heat Drop Kcal/Kg |
|---|---|---|---|---|
| T3 = 50.6 | P3 = .1293 | | h3 = 576.9 | 8.1 |
| T2 = 45.6 | P2 = .1005 | | h2 = 568.7 | 16.3 |
| T1 = 40.6 | P1 = .0775 | | h1 = 560.5 | 24.5 |
| T0 = 35.6 | | | | |
| T4 = 50.0 | P4 = .1258 | 7.56 | h4 = 576.1 | 0.0 |
| T3 = 45.0 | P3 = .0977 | | h3 = 567.9 | 8.2 |
| T2 = 40.0 | P2 = .0752 | | h2 = 559.7 | 16.4 |
| T1 = 35.0 | P1 = .0573 | | h1 = 551.3 | 24.8 |
| T0 = 30.0 | | | | |

TABLE III

TWO ZONE VS SINGLE ZONE PERFORMANCE 13.3° C. Temperature Rise

| Sat. Temp. °C. | Sat. Press Kcal/sqcm | Moisture, %, at P2 | Isentropic Enthalpy Kcal/Kg | Increased Heat Drop Kcal/Kg |
|---|---|---|---|---|
| T2 = 70.0 | P2 = .3178 | 4.42 | h2 = 602.8 | 0.0 |
| T1 = 63.3 | P1 = .2366 | | h1 = 592.4 | 10.4 |
| T0 = 56.7 | | | | |
| T2 = 64.4 | P2 = .2488 | 5.28 | h2 = 595.6 | 0.0 |
| T1 = 57.8 | P1 = .1831 | | h1 = 585.0 | 10.6 |
| T0 = 51.1 | | | | |
| T2 = 58.9 | P2 = .1929 | 6.12 | h2 = 588.3 | 0.0 |
| T1 = 52.2 | P1 = .1403 | | h1 = 577.6 | 10.7 |
| T0 = 45.6 | | | | |
| T2 = 53.3 | P2 = .1481 | 6.95 | h2 = 581.1 | 0.0 |
| T1 = 46.7 | P1 = .1064 | | h1 = 570.3 | 10.8 |
| T0 = 40.0 | | | | |
| T2 = 47.8 | P2 = .1126 | 7.86 | h2 = 573.3 | 0.0 |
| T1 = 41.1 | P2 = .0798 | | h1 = 562.3 | 11.0 |
| T0 = 34.4 | | | | |
| T2 = 42.2 | P2 = .0846 | 8.87 | h2 = 566.1 | 0.0 |
| T1 = 35.6 | P1 = .0591 | | h1 = 554.9 | 11.2 |
| T0 = 28.9 | | | | |

TABLE IV

FOUR ZONE VS SINGLE ZONE PERFORMANCE 13.3° C Temperature Rise

| Sat. Temp. °C. | Sat. Press Kcal/sqcm | Moisture, %, at P2 | Isentropic Enthalpy Kcal/Kg | Increased Heat Drop Kcal/Kg |
|---|---|---|---|---|
| T4 = 70.0 | P4 = .3178 | 4.42 | h4 = 602.8 | 0.0 |
| T3 = 66.7 | P3 = .2746 | | h3 = 597.6 | 5.2 |
| T2 = 63.3 | P2 = .2366 | | h2 = 592.4 | 10.4 |
| T1 = 60.0 | P1 = .2031 | | h1 = 587.1 | 15.7 |
| T0 = 56.7 | | | | |
| T4 = 64.4 | P4 = .2488 | 5.28 | h4 = 595.6 | 0.0 |
| T3 = 61.1 | P3 = .2138 | | h3 = 590.3 | 5.3 |
| T2 = 57.8 | P2 = .1831 | | h2 = 585.0 | 10.6 |
| T1 = 54.4 | P1 = .1563 | | h1 = 579.7 | 15.9 |
| T0 = 51.1 | | | | |
| T4 = 58.9 | P4 = .1929 | 6.12 | h4 = 588.3 | 0.0 |
| T3 = 55.6 | P3 = .1648 | | h3 = 583.0 | 5.3 |
| T2 = 52.2 | P2 = .1403 | | h2 = 577.6 | 10.7 |
| T1 = 48.9 | P1 = .1190 | | h1 = 572.2 | 16.1 |
| T0 = 45.6 | | | | |
| T4 = 53.3 | P4 = .1481 | 6.95 | h4 = 581.1 | 0.0 |
| T3 = 50.0 | P3 = .1258 | | h3 = 575.7 | 5.4 |
| T2 = 46.7 | P2 = .1064 | | h2 = 570.3 | 10.8 |
| T1 = 43.3 | P1 = .0896 | | h1 = 564.8 | 16.3 |
| T0 = 40.0 | | | | |
| T4 = 47.8 | P4 = .1126 | 7.86 | h4 = 573.3 | 0.0 |
| T3 = 44.4 | P3 = .0949 | | h3 = 567.8 | 5.5 |
| T2 = 41.1 | P2 = .0798 | | h2 = 562.3 | 11.0 |
| T1 = 37.8 | P1 = .0668 | | h1 = 556.8 | 16.5 |
| T0 = 34.4 | | | | |
| T4 = 42.2 | P4 = .0846 | 8.87 | h4 = 566.1 | 0.0 |
| T3 = 38.9 | P3 = .0709 | | h3 = 560.6 | 5.5 |
| T2 = 35.6 | P2 = .0591 | | h2 = 554.9 | 11.2 |
| T1 = 32.2 | P1 = .0491 | | h1 = 549.3 | 16.8 |

TABLE IV-continued

FOUR ZONE VS SINGLE ZONE PERFORMANCE
13.3° C Temperature Rise

| Sat. Temp. °C. | Sat. Press Kcal/sqcm | Moisture, %, at P2 | Isentropic Enthalpy Kcal/Kg | Increased Heat Drop Kcal/Kg |
|---|---|---|---|---|
| T0 = 28.9 | | | | |

TABLE V

STEAM PRESSURE AND TEMPERATURE IN SINGLE AND TWO ZONE CONDENSERS

| Cond. Rise °C. | Zone 1 Temp.* °C. | Zone 1 Press.* Kg/sqcm | Zone 2 Temp. °C. | Zone 2 Press. Kg/sqcm |
|---|---|---|---|---|
| 13.3 | 42.2 | .0846 | 35.6 | .0591 |
| 13.3 | 47.8 | .1126 | 41.1 | .0798 |
| 13.3 | 53.3 | .1481 | 46.7 | .1064 |
| 13.3 | 58.9 | .1929 | 52.2 | .1403 |
| 13.3 | 64.4 | .2488 | 57.8 | .1831 |
| 13.3 | 70.0 | .3178 | 63.3 | .2366 |
| 20.0 | 50.0 | .1258 | 40.0 | .0752 |
| 20.0 | 55.6 | .1648 | 45.6 | .1005 |
| 20.0 | 61.1 | .2138 | 51.1 | .1329 |
| 20.0 | 66.7 | .2747 | 56.7 | .1738 |
| 20.0 | 72.2 | .3496 | 62.2 | .2250 |
| 20.0 | 76.7 | .4213 | 66.7 | .2747 |

*Operating condition with an unzoned or single pressure condenser

TABLE VI

STEAM PRESSURE AND TEMPERATURE WITH TWO AND FOUR ZONE CONDENSERS

| Cond. Rise °C. | Zone 1 Temp.* °C. | Zone 1 Press.* Kg/sqcm | Zone 2 Temp. °C. | Zone 2 Press. Kg/sqcm |
|---|---|---|---|---|
| 13.3 | 42.2 | .0856 | 38.9 | .0709 |
| 13.3 | 47.8 | .1126 | 44.4 | .0949 |
| 13.3 | 53.3 | .1481 | 50.0 | .1258 |
| 13.3 | 58.9 | .1929 | 55.6 | .1648 |
| 13.3 | 64.4 | .2488 | 61.1 | .2138 |
| 13.3 | 70.0 | .3178 | 66.7 | .2747 |
| 20.0 | 50.0 | .1258 | 45.0 | .0977 |
| 20.0 | 55.6 | .1648 | 50.6 | .1293 |
| 20.0 | 61.1 | .2138 | 56.1 | .1693 |
| 20.0 | 66.7 | .2747 | 61.7 | .2193 |
| 20.0 | 72.2 | .3496 | 67.2 | .2815 |
| 20.0 | 76.7 | .4213 | 71.7 | .3414 |

| Cond. Rise °C. | Zone 1 Temp.* °C. | Zone 1 Press.* Kg/sqcm | Zone 2 Temp. °C. | Zone 2 Press. Kg/sqcm |
|---|---|---|---|---|
| 13.3 | 35.6 | .0591 | 32.2 | .0491 |
| 13.3 | 41.1 | .0798 | 37.8 | .0668 |
| 13.3 | 46.7 | .1064 | 43.3 | .0896 |
| 13.3 | 52.2 | .1403 | 48.9 | .1190 |
| 13.3 | 57.8 | .1831 | 54.4 | .1563 |
| 13.3 | 63.3 | .2366 | 60.0 | .2031 |
| 20.0 | 40.0 | .0752 | 35.0 | .0573 |
| 20.0 | 45.6 | .1005 | 40.6 | .0775 |
| 20.0 | 51.1 | .1329 | 46.1 | .1034 |
| 20.0 | 56.7 | .1738 | 51.7 | .1366 |
| 20.0 | 62.2 | .2250 | 57.2 | .1784 |
| 20.0 | 66.7 | .2747 | 61.7 | .2193 |

*Operating conditions with a two zone condenser

TABLE VII

INCREASE IN OUTPUT FROM ZONED CONDENSER 13.3° C. CONDENSER RISE SINGLE FLOW LP SECTION TWO ZONE VS ONE ZONE CONFIGURATION (EFFECT OF HOOD LOSS INCREASE, ΔHL, ON TWO ZONE CONFIGURATION)

| Steam Temp. Top Zone, °C. | 1 Zone Output, KW | Two Zone Output, KW ΔHL = 0* KW | ΔHL = 0.68* KW | ΔHL = 1.1* KW | ΔHL = 1.7* KW |
|---|---|---|---|---|---|
| 42.2 | 432,725 | 432,787 | 432,766 | 432,735 | 432,690 |
| 47.8 | 429,689 | 431,184 | 431,076 | 430,883 | 430,729 |
| 53.3 | 423,476 | 427,021 | 426,545 | 426,207 | 425,873 |
| 58.9 | 414,776 | 419,772 | 419,299 | 418,809 | 418,294 |
| 64.4 | 405,368 | 410,845 | 410,272 | 409,698 | 409,133 |
| 70.0 | 395,559 | 401,258 | 400,640 | 400,495 | 399,936 |

TABLE VII-continued

INCREASE IN OUTPUT FROM ZONED CONDENSER 13.3° C. CONDENSER RISE SINGLE FLOW LP SECTION TWO ZONE VS ONE ZONE CONFIGURATION (EFFECT OF HOOD LOSS INCREASE, ΔHL, ON TWO ZONE CONFIGURATION)

| Steam Temp. Top Zone, °C. | 1 Zone Output, KW | Two Zone Increase In Output, KW ΔHL = 0* KW | ΔHL = 0.68* KW | ΔHL = 1.1* KW | ΔHL = 1.7* KW |
|---|---|---|---|---|---|
| 42.2 | 432,725 | 62 | 41 | 10 | −35 |
| 47.8 | 429,689 | 1495 | 1387 | 1194 | 1040 |
| 53.3 | 423,476 | 3545 | 3069 | 2731 | 2397 |
| 58.9 | 414,776 | 4996 | 4523 | 4033 | 3518 |
| 64.4 | 405,368 | 5487 | 4904 | 4330 | 3765 |
| 70.0 | 395,559 | 5699 | 5081 | 4936 | 4377 |

*ΔHL is given Kcal/Kg

TABLE VIII

INCREASE IN OUTPUT FROM ZONED CONDENSER 20.0° C. CONDENSER RISE SINGLE FLOW LP SECTION TWO ZONE VS ONE ZONE CONFIGURATION (EFFECT OF HOOD LOSS INCREASE, ΔHL, ON TWO ZONE CONFIGURATION)

| Steam Temp. Top Zone, °C. | 1 Zone Output, KW | Two Zone Output, KW ΔHL = 0* KW | ΔHL = 0.68* KW | ΔHL = 1.1* KW | ΔHL = 1.7* KW |
|---|---|---|---|---|---|
| 50.0 | 427,568 | 430,078 | 429,741 | 429,761 | 429,577 |
| 55.6 | 420,009 | 425,442 | 425,111 | 424,784 | 424,434 |
| 61.1 | 411,040 | 418,523 | 418,052 | 417,574 | 417,096 |
| 66.7 | 401,615 | 409,790 | 409,221 | 408,582 | 408,010 |
| 72.2 | 392,153 | 400,423 | 399,735 | 399,038 | 398,338 |
| 76.7 | 382,232 | 391,628 | 390,899 | 390,177 | 389,391 |

| Steam Temp. Top Zone, °C. | 1 Zone Output, KW | Two Zone Increase In Output, KW ΔHL = 0* KW | ΔHL = 0.68* KW | ΔHL = 1.1* KW | ΔHL = 1.7* KW |
|---|---|---|---|---|---|
| 50.0 | 427,568 | 2510 | 2373 | 2193 | 2009 |
| 55.6 | 420,009 | 5433 | 5002 | 4775 | 4425 |
| 61.1 | 411,040 | 7483 | 7012 | 6534 | 6056 |
| 66.7 | 401,615 | 8175 | 7606 | 6967 | 6395 |
| 72.2 | 392,153 | 8270 | 7582 | 6885 | 6185 |
| 76.7 | 382,232 | 9396 | 8667 | 7945 | 7159 |

*ΔHL is given Kcal/Kg

TABLE IX

INCREASE IN OUTPUT FROM ZONED CONDENSER 13.3° C. CONDENSER RISE DOUBLE FLOW LP SECTION FOUR ZONE VS TWO ZONE CONFIGURATION (EFFECT OF HOOD LOSS INCREASE, ΔHL, ON TWO ZONE CONFIGURATION)

| Steam Temp. Top Zone, °C. | 2 Zone Output, KW | Four Zone Output, KW ΔHL = 0* KW | ΔHL = 0.68* KW | ΔHL = 1.1* KW | ΔHL = 1.7* KW |
|---|---|---|---|---|---|
| 42.2 | 432,787 | 432,805 | 432,709 | 432,697 | 432,677 |
| 47.8 | 431,184 | 431,613 | 431,503 | 431,407 | 431,289 |
| 53.3 | 427,021 | 428,303 | 428,037 | 427,754 | 427,475 |
| 58.9 | 419,772 | 421,913 | 421,475 | 421,030 | 420,523 |

TABLE IX-continued

INCREASE IN OUTPUT FROM ZONED CONDENSER 13.3° C. CONDENSER RISE DOUBLE FLOW LP SECTION FOUR ZONE VS TWO ZONE CONFIGURATION (EFFECT OF HOOD LOSS INCREASE. ΔHL. ON TWO ZONE CONFIGURATION)

| | | | | | |
|---|---|---|---|---|---|
| 64.4 | 410.845 | 413.474 | 413.138 | 412.386 | 411.884 |
| 70.0 | 401.258 | 403.819 | 403.336 | 402.423 | 402.172 |

| Steam Temp. Top Zone. °C. | 2 Zone Output. KW | Two Zone Increase In Output. KW ΔHL = 0* KW | ΔHL = 0.68* KW | ΔHL = 1.1* KW | ΔHL = 1.7* KW |
|---|---|---|---|---|---|
| 42.2 | 432.787 | 18 | −78 | −90 | −110 |
| 47.8 | 431.184 | 429 | 319 | 223 | 105 |
| 53.3 | 427.021 | 1282 | 1016 | 733 | 454 |
| 58.9 | 419.772 | 2141 | 1703 | 1258 | 751 |
| 64.4 | 410.845 | 2629 | 2293 | 1541 | 1039 |
| 70.0 | 401.258 | 2561 | 2078 | 1165 | 914 |

*ΔHL is give Kcal/Kg

TABLE X

INCREASE IN OUTPUT FROM ZONED CONDENSER 20.0° C. CONDENSER RISE DOUBLE FLOW LP SECTION FOUR ZONE VS TWO ZONE CONFIGURATION (EFFECT OF HOOD LOSS INCREASE. ΔHL. ON TWO ZONE CONFIGURATION)

| Steam Temp. Top Zone. °C. | 2 Zone Output. KW | Four Zone Output. KW ΔHL = 0* KW | ΔHL = 0.68* KW | ΔHL = 1.1* KW | ΔHL = 1.7* KW |
|---|---|---|---|---|---|
| 50.0 | 430.078 | 431.958 | 431.083 | 430.737 | 430.609 |
| 55.6 | 425.442 | 427.443 | 427.192 | 426.936 | 426.665 |
| 61.1 | 418.523 | 421.601 | 421.195 | 420.787 | 420.257 |
| 66.7 | 409.790 | 413.684 | 413.148 | 412.601 | 412.029 |
| 72.2 | 400.433 | 403.910 | 403.181 | 402.418 | 401.648 |
| 76.7 | 391.628 | 394.653 | 393.275 | 392.396 | 391.802 |

| Steam Temp. Top Zone. °C. | 2 Zone Output. KW | Four Zone Increase In Output. KW ΔHL = 0* KW | ΔHL = 0.68* KW | ΔHL = 1.1* KW | ΔHL = 1.7* KW |
|---|---|---|---|---|---|
| 50.0 | 430.078 | 1880 | 1005 | 659 | 531 |
| 55.6 | 425.442 | 2001 | 1750 | 1494 | 1223 |
| 61.1 | 418.523 | 3078 | 2672 | 2264 | 1734 |
| 66.7 | 409.790 | 3894 | 3358 | 2811 | 2239 |
| 72.2 | 400.433 | 3477 | 2748 | 1985 | 1215 |
| 76.7 | 391.628 | 3025 | 1647 | 768 | 174 |

*ΔHL is given Kcal/Kg

What is claimed is:

1. A low pressure steam turbine and condenser combination having multiple pressure zones in a single exhaust flow comprising:

a condenser divided into multiple sectors;

a turbine housing in fluid communication with said condenser for passing exhaust steam from the turbine into the condenser;

at least one exhaust outlet coupled to the turbine and positioned to exhaust steam into said housing;

at least one divider plate positioned in said exhaust outlet and extending into said housing for dividing exhaust steam into at least two separated flow paths, each flow path being coupled to a respective one of the multiple sectors of said condenser; and a plurality of slots in said at least one divider plate adjacent said at least one exhaust outlet for controlling flow separation related to swirl in the steam at relatively high exhaust pressure.

2. The combination of claim 1 wherein the turbine comprises a double flow turbine having a second exhaust outlet positioned to exhaust steam into said housing and further comprising:

a second divider plate positioned in said second outlet and extending into said housing for dividing exhaust steam from said second outlet into at least two separate second flow paths, each of said second flow paths being coupled to a respective one of the multiple sectors of said condenser.

3. The combination of claim 2 and including a third divider plate extending through said housing generally transverse to the orientation of said at least one divider plate and said second divider plate for separating exhaust flow from each exhaust outlet into two substantially isolated portions of said housing.

4. A low pressure steam turbine and condenser combination, the turbine having at least one exhaust annulus for exhaust steam, the improvement comprising:

means for dividing the exhaust steam into at least two substantially isolated flows, and means directing each of the two flows into respective sections of the condenser, said dividing means comprising a divider plate positioned in said annulus and dividing said exhaust steam into two substantially equal parts, and including vents in said divider plate for permitting flow from one side of said plate to another for controlling flow separation when swirl is present in the steam flow.

5. The combination of claim 1 wherein the turbine comprises a double flow turbine and wherein each exhaust thereof is divided into at least two flows, each of said flows being directed through respective isolated sections of the condenser.

6. The combination of claim 2 wherein the condenser comprises a shell and tube condenser and including baffling disposed in the condenser for isolating the two flows therethrough.

* * * * *